US007114593B1

(12) United States Patent
Duke

(10) Patent No.: US 7,114,593 B1
(45) Date of Patent: Oct. 3, 2006

(54) APPARATUS FOR HOLDING AND RETAINING A MOTOR VEHICLE FOR LIFTING

(76) Inventor: Todd Duke, 3678 E. Simpson Ct., Gilbert, AZ (US) 85927

( * ) Notice: Subject to any disclaimer, the term of this patent is extended or adjusted under 35 U.S.C. 154(b) by 440 days.

(21) Appl. No.: 10/627,089

(22) Filed: Jul. 25, 2003

(51) Int. Cl.
*B66F 7/28* (2006.01)

(52) U.S. Cl. ..... 187/218; 187/219; 187/220; 254/134; 72/447

(58) Field of Classification Search ..... 187/218, 187/216, 219, 211, 215; 254/134
See application file for complete search history.

(56) References Cited

U.S. PATENT DOCUMENTS 4,574,614 A * 3/1986 Field ..... 72/447
4,585,092 A * 4/1986 Dossier ..... 187/218
6,471,009 B1 * 10/2002 Mabry et al. ..... 187/218

* cited by examiner

*Primary Examiner*—Kathy Matecki
*Assistant Examiner*—Terrell Matthews
(74) *Attorney, Agent, or Firm*—Michael I Kroll

(57) ABSTRACT

An apparatus for holding and retaining a vehicle to be lifted comprising a plurality of transverse assemblies with each including a pair of crossbeams attached to one another in a spaced apart parallel manner by means of end plates having a plurality of recesses therein. Frame anchor assemblies are slidably disposed within the channel between the cross-beams and adjust to support the frames of various sized motor vehicles.

7 Claims, 9 Drawing Sheets

APPARATUS FOR HOLDING AND RETAINING A MOTOR VEHICLE FOR LIFTING

BACKGROUND OF THE INVENTION

1. Field of the Invention

The present invention relates generally to anchor stands and, more specifically, to a vehicle holding apparatus for use as a support platform engaging the frame of the vehicle. The apparatus is comprised of spaced apart longitudinal crossbeams having a spacer medially positioned and end plates fastened at the distal end. The end plates have apertures providing means for attaching a stand suspending the crossbeams therebetween. The present invention further comprises a planar base plate, an L-shaped frame anchor insert and a frame anchor sleeve having a cantilevered bracket forming an integral part therewith.

A pair of frame anchor assemblies are positioned within and spaced at opposing ends of the transverse channel formed by the crossbeams. The frame anchor inserts are fastened to base plates by means of fasteners wherein they are contained between the crossbeams with the base plates engaging the bottom surface of the crossbeams. The lower horizontal portion of the L-shaped frame anchor inserts form the guide member for slidably positioning the frame anchor assemblies. The frame anchor sleeves have a plurality of recesses that mate with opposing recesses positioned within the frame anchor inserts. A bearing plate having a slot conforming substantially to the frame anchor insert is fastened encompassing the vertical portion of the L-shaped frame anchor insert that continues to extend therethrough whereby the frame anchor sleeve can be placed thereon once the recesses of the frame anchor sleeve and frame anchor insert are aligned fasteners are inserted to fix said positioning. The frame anchor sleeve while being fastened to the frame anchor insert also engages the upper bearing plate thereby fixedly positioning the frame anchor assembly within the spaced apart crossbeams. Once positioned the opposing cantilevered brackets will engage the bottom of the vehicle frame while the adjacent wall engages the vehicle frame wall thereby creating a vehicle holding system.

2. Description of the Prior Art

There are other support devices designed for automotive tasks. While these support devices may be suitable for the purposes for which they were designed, they would not be as suitable for the purposes of the present invention, as hereinafter described.

It is thus desirable that there exist an apparatus for holding a motor vehicle that is designed for use with heavier vehicles such as SUV's or full frame trucks whereby frame straightening and other related automotive tasks can be performed.

SUMMARY OF THE PRESENT INVENTION

A primary object of the present invention is to provide an apparatus for holding a motor vehicle for heavier vehicles such as pickup trucks and SUV's.

Another object of the present invention is to provide an apparatus for holding a motor vehicle that prevents movement of the vehicular frame after positioned therein.

Yet another object of the present invention is to provide an apparatus for holding a motor vehicle that reduces the setup time for vehicle frame adjustments.

Still yet another object of the present invention is to provide an apparatus for holding a motor vehicle wherein pressure can be applied in either pulling or pushing without the vehicle being displaced from the preselected operative position.

Another object of the present invention is to provide an apparatus for holding a motor vehicle having a pair of spaced apart crossbeams having a medially positioned spacer and fixedly positioned end plates fastened to their distal ends.

Yet another object of the present invention is to provide an apparatus for holding a motor vehicle wherein said crossbeam end plates have means for attaching stands thereto.

Still yet another object of the present invention is to provide an apparatus for holding a motor vehicle wherein frame anchor assemblies are slidably contained within the spaced apart crossbeams.

Another object of the present invention is to provide an apparatus for holding a motor vehicle wherein the frame anchor assemblies engage the base and adjacent exterior wall of said vehicular frame.

Yet another object of the present invention is to provide an apparatus for holding a motor vehicle wherein the frame anchor assemblies have planar members engaging the top and bottom sides of the crossbeams.

Still yet another object of the present invention is to provide an apparatus for holding a motor vehicle wherein the frame anchor assembly further comprises a frame anchor sleeve.

Yet another object of the present invention is to provide compatible recesses within the frame anchor insert and frame anchor sleeve whereby said components can be fastened together.

Additional objects of the present invention will appear as the description proceeds.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
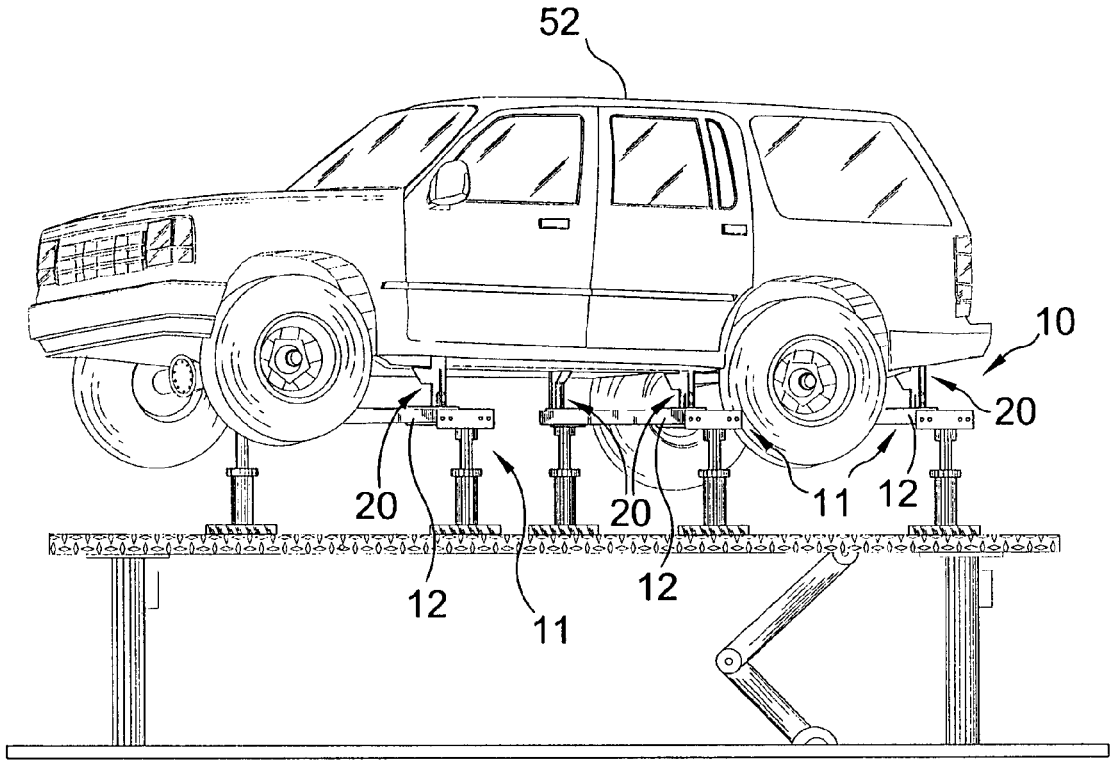
FIG. 1 is an illustrative view of the present invention in use.

Turning now descriptively to the drawings, in which similar reference characters denote similar elements throughout the several views, the figures illustrate the Vehicle Holding System of the present invention. With regard to the reference numerals used, the following numbering is used throughout the various drawing FIGURES.

10 apparatus for holding and retaining a vehicle to be lifted
11 transverse assembly
12 treadway
14 crossbeam of 12
15 transverse channel of 14
16 end plate of 12
17 recesses of 16
18 spacer element of 12
20 frame anchor assembly
22 frame anchor sleeve
24 recesses of 22
26 cantilevered bracket of 22
27 hollow interior of 22
28 frame anchor insert
30 vertical portion of 28
32 horizontal portion of 28
34 top of 32
36 bottom of 32
38 threaded recesses of 30
40 threaded recesses of 36
42 bearing plate
44 slotted cut-out of 42
45 frame anchor assembly securing means
46 base plate
48 recesses of 46
50 threaded bolt
52 vehicle
54 retaining flange of 16

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention 10 is an apparatus for holding and retaining a vehicle 52 that is to be lifted comprising at least two elongated transverse assemblies 11 with each treadway 12 including a pair of laterally repositionable frame anchor assemblies 20 for supporting a motor vehicle 52 whereby abutting the frame anchor assemblies 20 to the side and bottom of the vehicle=s underlying frame members allows the vehicle 52 to rest on its frame and not the suspension thereof. The opposing ends of the treadway 12 are connected to various suitable anchoring devices. A frame-straightening device can be used during use of the present invention 10 considerably decreasing the labor associated with auto body repair tasks.

Figure 2:
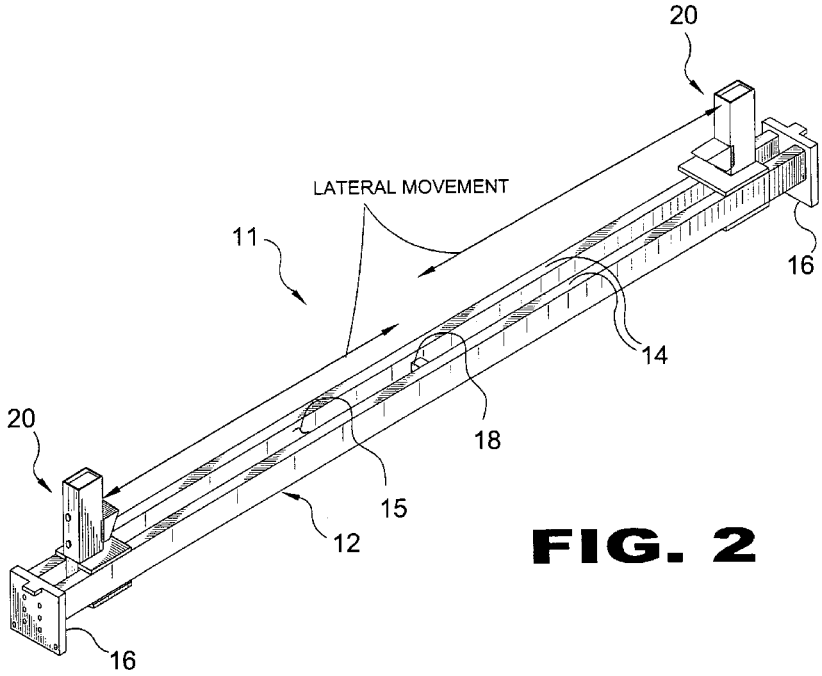
FIG. 2 is a perspective view of the present invention.

FIG. 2 is a perspective view of a transverse assembly 11 of the present invention 10. The transverse assembly 11 of the present invention 10 comprises a treadway 12 formed by a pair of spaced apart elongate crossbeams 14 bound together at the opposing ends thereof by endplates 16 and a pair of removable and laterally repositionable frame anchor assemblies 20 disposed in the transverse channel 15 between said crossbeams 14 which may slide laterally across the surface thereof giving the apparatus compatibility with a wide range of motor vehicle 52 frame sizes.

Figure 3:
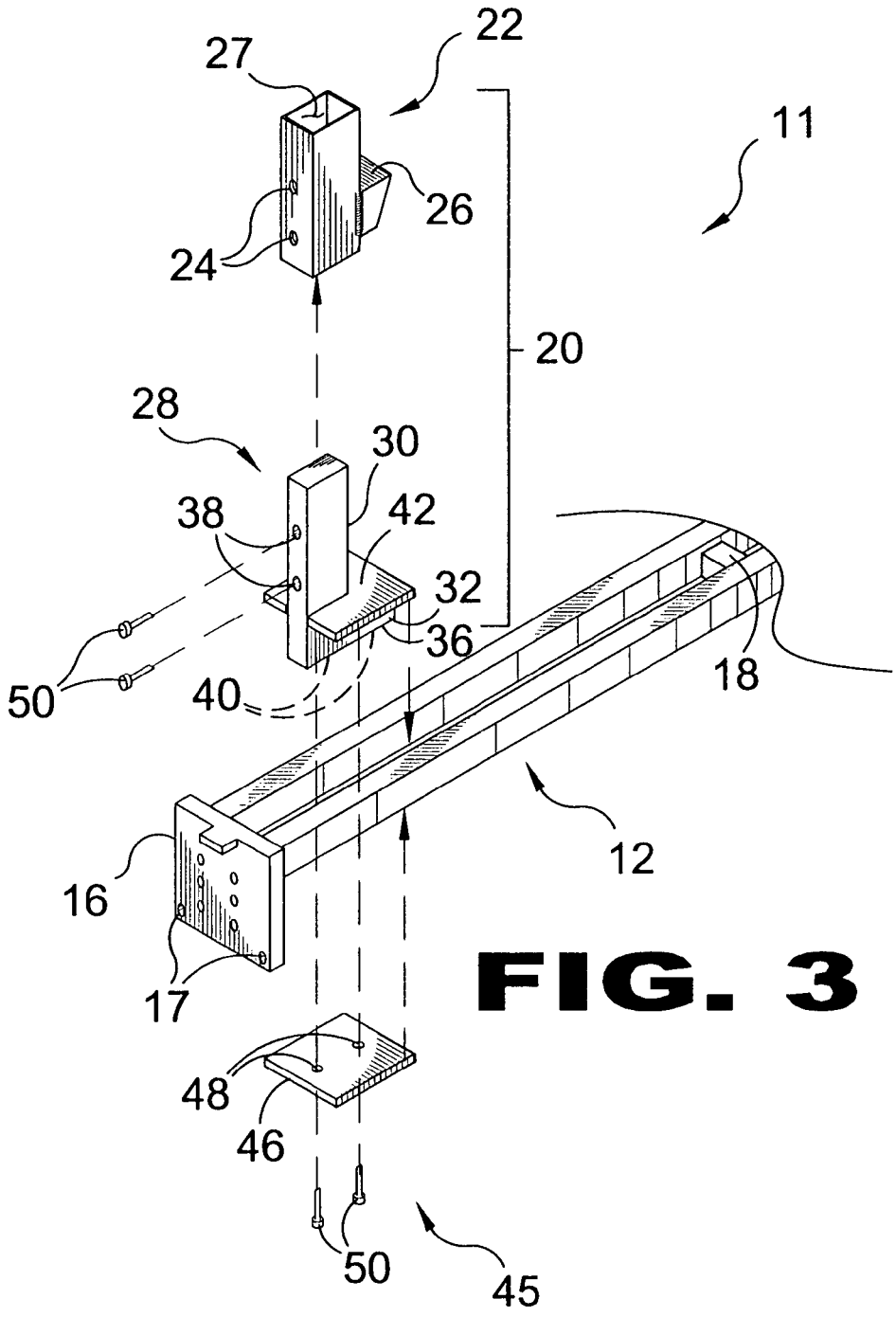
FIG. 3 is an exploded view of the transverse assembly of the present invention.

FIG. 3 is an exploded view of a transverse assembly 11 of the present invention 10. Shown is the treadway 12 comprised of a pair of spaced apart crossbeams 14 conjoined by a pair of end plates 16 on the distal ends thereof. The end plates 16 have a plurality of recesses 17 extending therethrough. The frame anchor assembly 20 includes a frame anchor sleeve 22 with a hollow interior 27 into which the vertical portion 30 of the frame anchor insert 28 is inserted. A plurality of recesses 24 in the frame anchor sleeve 22 align with the threaded recesses 38 that pass through the entirety of the frame anchor insert 28 and threaded bolts 50 are inserted therein to secure the two components together. A cantilevered bracket 26 projects from the frame anchor sleeve 22 on which the frame of the vehicle 52 is to rest as the upper portion of the frame anchor insert 28 sits flush thereagainst. The slotted bearing plate 42 is seated flush on the top side 34 of the horizontal portion 32 of the frame anchor insert 28 and is welded thereto. A frame anchor assembly 22 securing means 45 comprises a base plate 46 having a plurality of recesses 48 that align with a plurality of threaded recesses 48 disposed on the bottom 36 of the horizontal portion 32 of the frame anchor insert 28 and threaded bolts 50 are inserted therethrough as the bearing plate 42 and base plate 46 are pulled towards one another against the treadway 12 to serve as a sandwich clamp to prevent the frame anchor assembly 20 from inadvertent lateral or vertical movement once in the selected position. A spacer element 18 in the transverse channel 15 is in communication with the two crossbeams 14.

Figure 4:
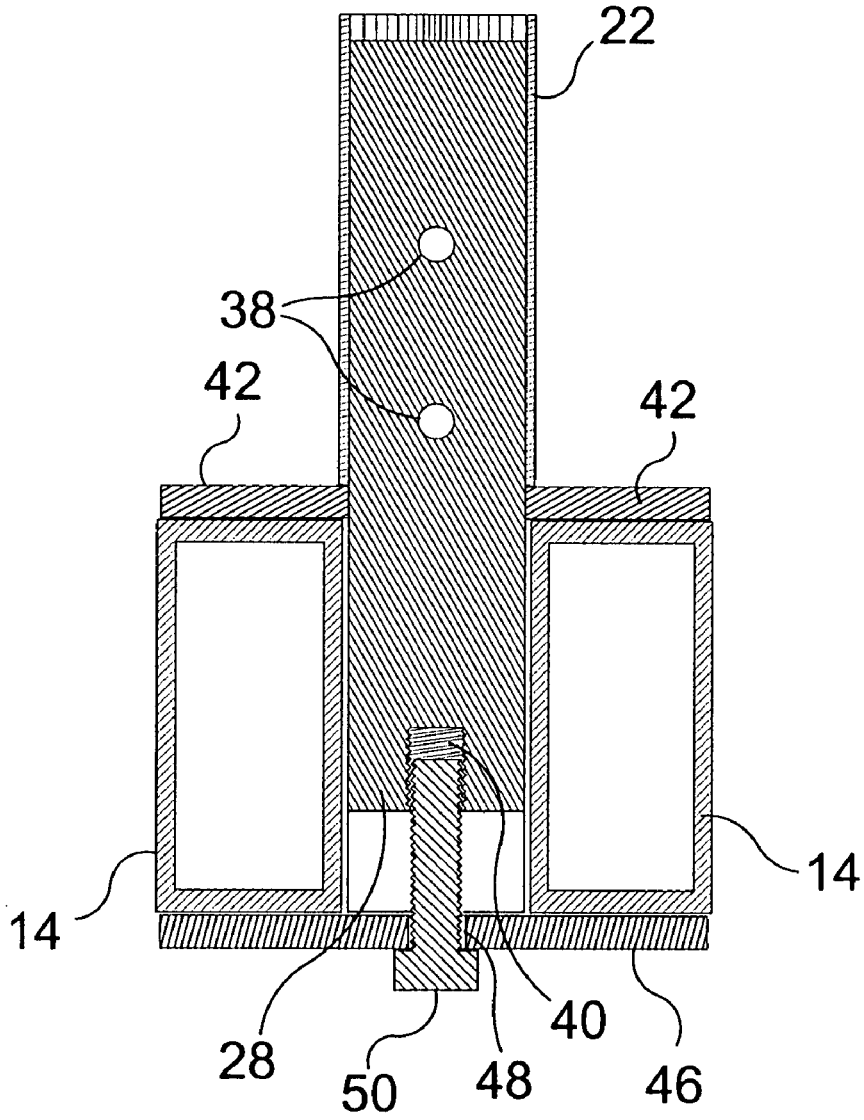
FIG. 4 is a sectional view of the frame anchor assembly within the treadway.

FIG. 4 is a sectional view of the frame anchor assembly 20 within the treadway 12. The base plate 46 is flush to the lower outer surface of the crossbeams 14 and the bearing plate 42 is flush to the upper outer surface of the crossbeams 14. When the bolts 50 are loosened the base plate 46 has ample space between its surface and the crossbeams 14 for the lateral movement of the frame anchor assembly 20 along the treadway 12 and the bolts 50 may be tightened when the lateral movement thereof is not desired. The bolts 50 pass through the recesses 48 of the base plate 46 and are threaded into the threaded recesses 40 in the bottom 36 of the horizontal portion 32 of the frame anchor insert 28. The frame anchor sleeve 22 encompasses the frame anchor insert 28 and rests on the surface of the bearing plate 42. The width of the frame anchor insert 28 is slightly smaller than the distance in the transverse channel 15 of the treadway 12.

Figure 5:
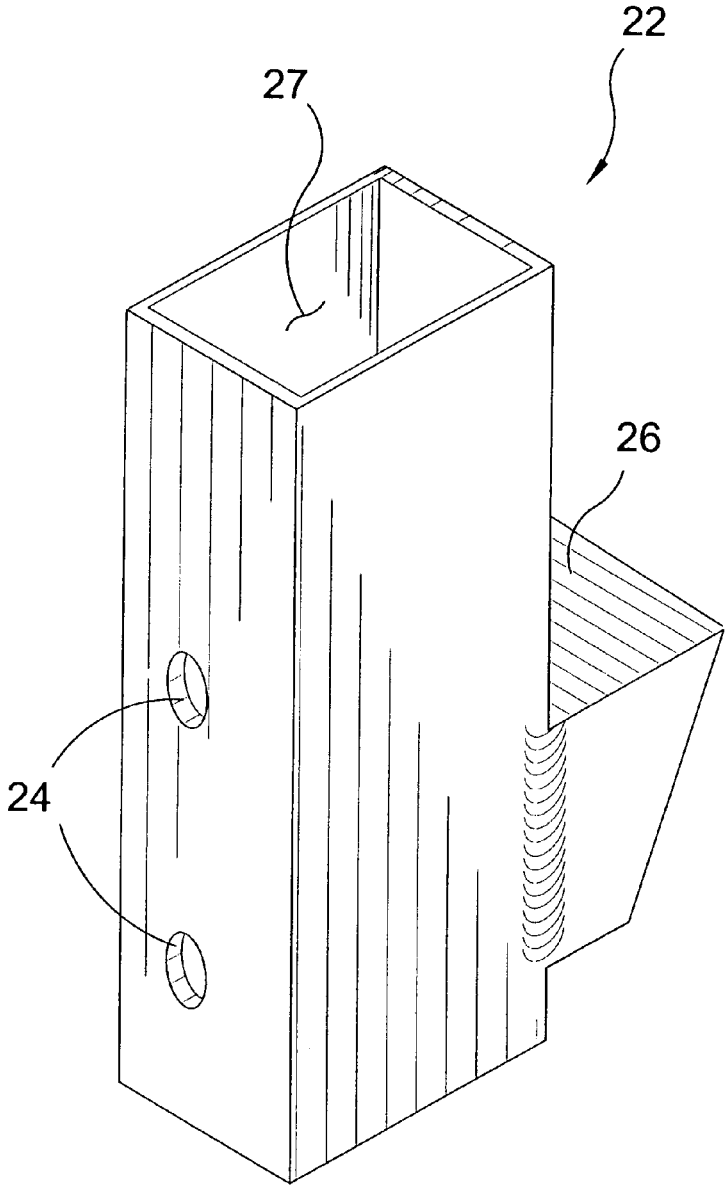
FIG. 5 is an enlarged view of the supportive vehicle frame anchor sleeve.

FIG. 5 is an enlarged view of the frame anchor sleeve 22. The frame anchor sleeve 22 is comprised of a tubular rigid material having a plurality of recesses 24 and a cantilevered bracket 26 extending therefrom. The frame anchor sleeve 22 slides over the frame anchor insert 28 and rests flush on the surface of the bearing plate 42.

Figure 6:
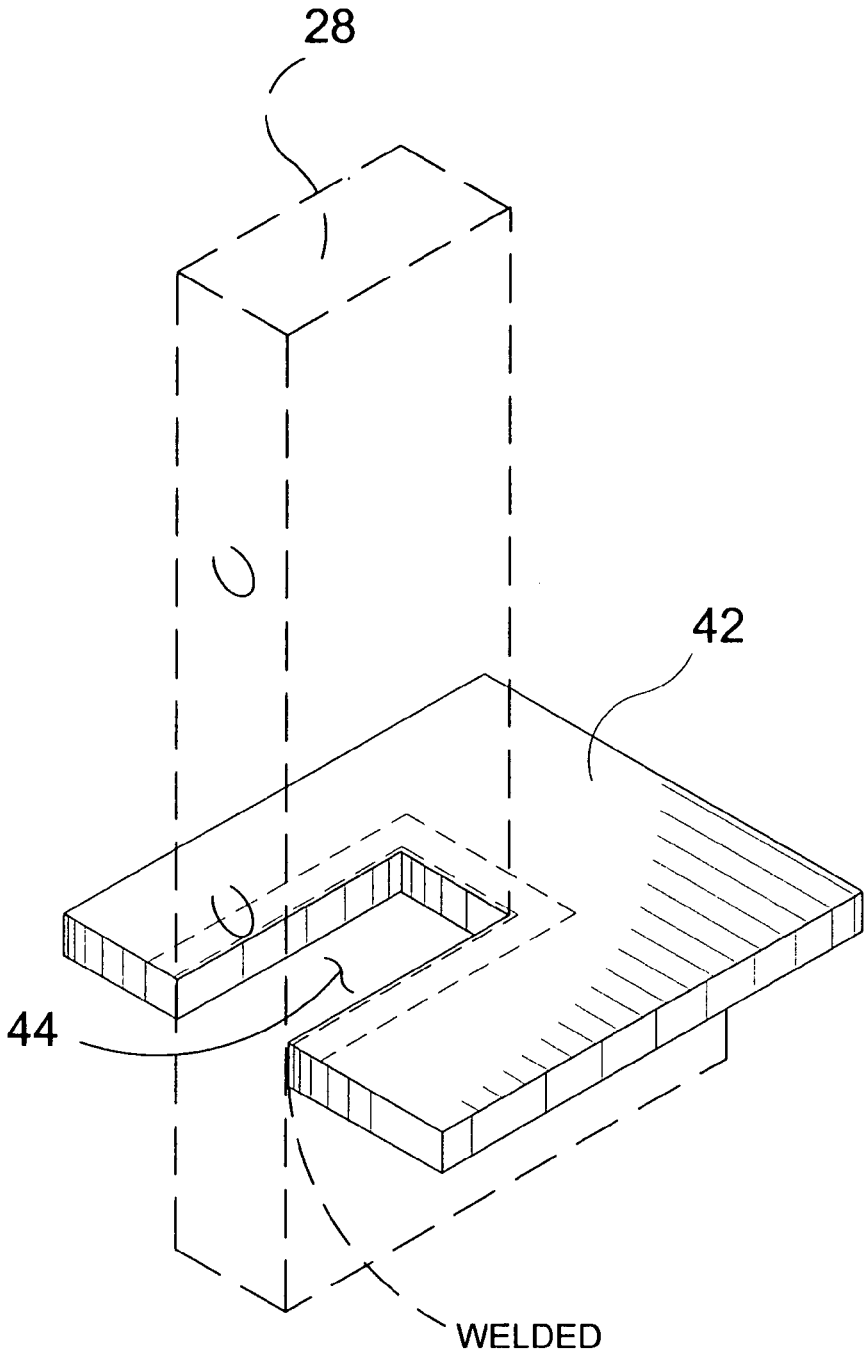
FIG. 6 is an enlarged view of the bearing plate.

FIG. 6 is an enlarged view of the bearing plate 42. The frame anchor insert has a bearing plate fabricated of a rigid planar material with a slotted cut-out 44 therein. The frame anchor sleeve 22 will rest on the edge surface surrounding the slot. The width of the frame anchor sleeve 22 is greater than the distance in the slot of the bearing plate 42. The dashed line indicates the resting edge of the frame anchor sleeve 22.

Figure 7:
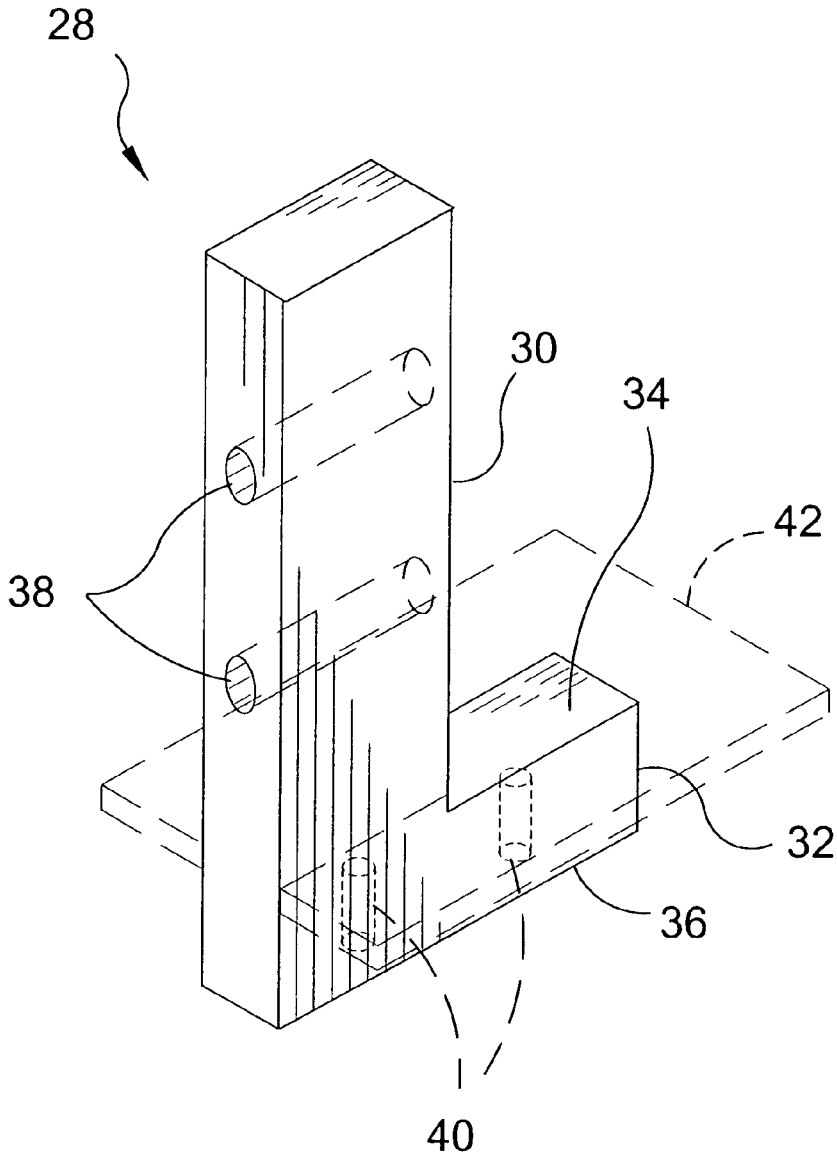
FIG. 7 is an enlarged view of the frame anchor insert.

FIG. 7 is an enlarged view of the frame anchor insert 28 which is fabricated of a rigid material having a plurality of threaded recesses 40 drilled and tapped 1¾@ deep on the bottom 36 of the horizontal portion 32 for the attachment of the base plate 46 to the frame anchor insert 28. The width and length of the vertical portion 30 of the frame anchor insert 28 is smaller than the hollow interior 27 of the frame anchor sleeve 22 and slot within the bearing plate 42. The threaded recesses 38 of the vertical portion 30 of the frame anchor insert 28 pass entirely therethrough.

Figure 8:
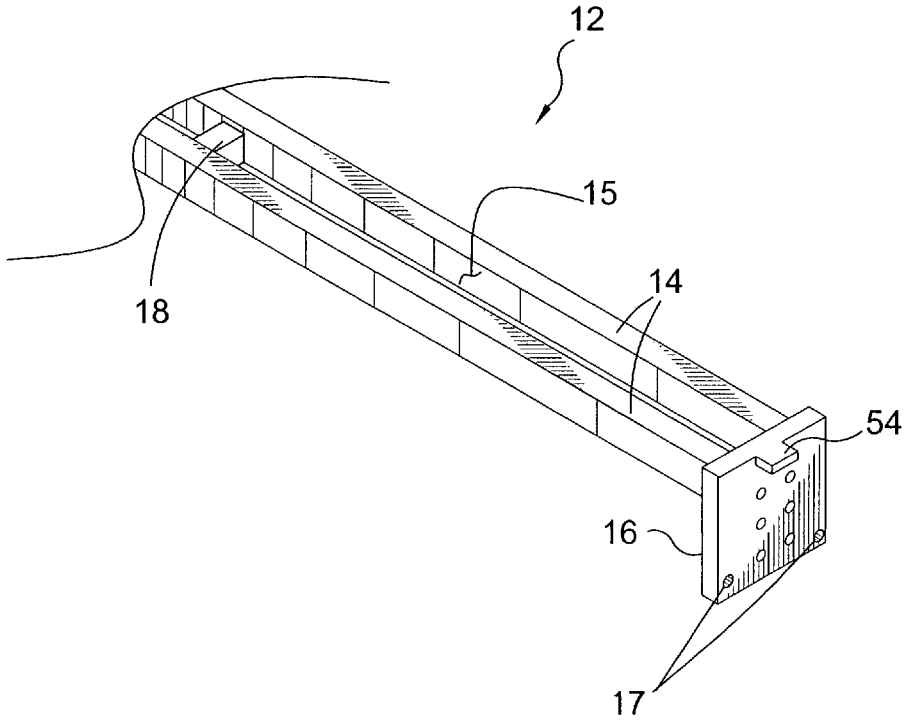
FIG. 8 is an enlarged view of the treadway.

FIG. 8 is an enlarged view of the treadway 12. The treadway 12 of the present invention 10 is comprised of two rigid elongate crossbeams 14 conjoined by end plates 16 fixedly bound on the opposing ends thereof with a plurality of recesses 17 and a supportive extending lip thereon. The end plates 16 will accept a wide variety of vehicle anchor stand systems. The extended retaining flanges 54 on the end plates 16 will rest on the surface of the anchor stand attaching plates decreasing the vehicle weight load on the fasteners preventing them from shearing.

Figure 9:
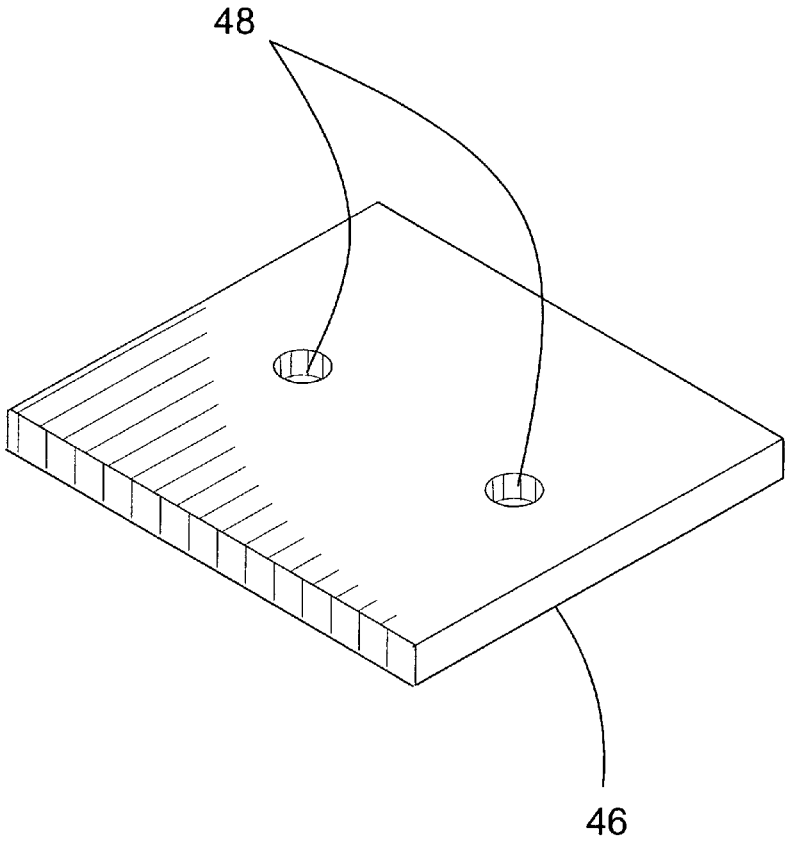
FIG. 9 is an enlarged view of the base plate.

FIG. 9 is an enlarged view of the base plate 46. The base plate 46 of the present invention 10 is comprised of a rigid planar material having a plurality of recesses 48 therein. The base plate 46 is removably attached to the frame anchor insert 28. The base plate 46 prevents vertical movement of the laterally moveable frame anchor assembly 20 relative to the treadway 12.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. An apparatus for holding and retaining a vehicle to be lifted comprising at least two parallel transverse assemblies, each transverse assembly comprising:

a) a treadway comprising:

i) two spaced apart parallel crossbeams with each said crossbeam having a first end, a second end, a top side and a bottom side;

ii) a pair of end plates with one said end plate fastened to said first ends of said crossbeams and the other said end plate fastened to said second ends of said crossbeams to maintain a constant spaced apart relation thereof while forming a solid connection between the two crossbeams;

iii) a transverse channel formed by the space between said crossbeams; and b) a pair of opposing frame anchor assemblies slidably disposed within said transverse channel and resting on said top sides of said crossbeams and extending from said transverse channel thereby enabling said frame anchor assemblies to be selectively positioned along the longitudinal axis of said crossbeams to accommodate the width of the frame of the vehicle to be raised and to bear the weight thereof, wherein each said frame anchor assembly comprises:

a) a frame anchor having a width conforming with said transverse channel for the partial insertion therein with minimal play between said crossbeams while a substantial portion extends vertically beyond said top sides of said crossbeams;

b) a substantially horizontal bearing plate integral with said frame anchor wherein said hearing plate is seated on said top sides of said crossbeams to maintain the vertical position of said frame anchor assembly even when under a load;

c) a cantilevered bracket extending perpendicularly from a central portion of said frame anchor and medially oriented in regard to said treadway for bearing the underside of the frame of the vehicle to be raised while the portion of said frame anchor extending thereabove is in physical contact with the peripheral side of the vehicle frame; and d) means for securing said frame anchor assembly to prevent the lateral movement thereof along the longitudinal axis of said treadway e) a substantially L-shaped frame anchor insert having a lower horizontal portion to reside within said transverse channel and an upper vertical portion extending above said treadway; and f) a frame anchor sleeve having a hollow interior conforming to the size and shape of said vertical portion to allow for the snug insertion therethrough.

2. An apparatus for holding and retaining a vehicle to be lifted as recited in claim 1, wherein said bearing plate has a slotted cut-out conforming to the shape of said vertical portion of said frame anchor insert for the placement therearound as the adjacent central portion of said bearing plate is seated on the top of said horizontal portion of said frame anchor insert and welded thereto.

3. An apparatus for holding and retaining a vehicle to be lifted as recited in claim 1, wherein said frame anchor sleeve has a plurality of recesses in vertical alignment on the side opposite that with said cantilevered bracket.

4. An apparatus for holding and retaining a vehicle to be lifted as recited in claim 3, wherein said frame anchor insert has a plurality of threaded recesses in alignment with said recesses in said frame anchor sleeve.

5. An apparatus for holding and retaining a vehicle to be lifted as recited in claim 4, further including a plurality of bolts to be inserted through said recesses of said frame anchor sleeve and said aligned threaded recesses of said frame anchor insert to retain the two components to one another.

6. An apparatus for holding and retaining a vehicle to be lifted as recited in claim 1, wherein said treadway further includes a spacer element medially positioned within said transverse channel and communicating between said crossbeams.

7. An apparatus for holding and retaining a vehicle to be lifted as recited in claim 1, wherein said end plates further include a retaining flange extending perpendicularly from the top portion thereof to rest on the frame rack to relieve pressure on the bolts to prevent them from shearing.

* * * * *